US005224331A

United States Patent [19]

Stahlecker et al.

[11] Patent Number: 5,224,331

[45] Date of Patent: Jul. 6, 1993

[54] TEXTILE MACHINE, PARTICULARLY A SPINNING OR TWISTING MACHINE

[75] Inventors: Gerd Stahlecker, Eislingen/Fils; Heinz Späth, Geislingen; Albert Straub, Weinstadt/Schnait, all of Fed. Rep. of Germany

[73] Assignee: Novibra GmbH, Fed. Rep. of Germany

[21] Appl. No.: 508,172

[22] Filed: Apr. 12, 1990

[30] Foreign Application Priority Data

Apr. 14, 1989 [DE] Fed. Rep. of Germany ..... 3912370

[51] Int. Cl.[5] ..... H01R 25/00; D01H 1/24

[52] U.S. Cl. ..... 57/100; 57/264; 439/114

[58] Field of Search ..... 57/100, 81, 90, 264; 439/207, 209, 215, 212, 113-114

[56] References Cited

U.S. PATENT DOCUMENTS

| | | | |
|---|---|---|---|
| 1,723,528 | 8/1929 | Schneider | 57/100 |
| 2,107,378 | 2/1938 | Kato | 57/137 |
| 2,138,658 | 11/1938 | Hongo | 57/100 |
| 2,887,842 | 5/1959 | Cocker | 57/100 X |
| 3,732,677 | 5/1973 | Seem et al. | 57/100 X |
| 4,472,761 | 8/1984 | Koslosky et al. | 439/114 X |
| 4,735,039 | 4/1988 | Wunderlich | 57/137 |
| 4,874,322 | 10/1989 | Dola et al. | 439/215 X |
| 4,888,452 | 12/1989 | Krehl et al. | 57/100 X |
| 4,891,566 | 2/1990 | Sturwald et al. | 57/100 X |
| 4,989,402 | 2/1991 | Sloupensky | 57/264 |

FOREIGN PATENT DOCUMENTS

| | | | |
|---|---|---|---|
| 3727939 | 3/1989 | Fed. Rep. of Germany . | |
| 3838418 | 5/1990 | Fed. Rep. of Germany | 57/100 |

OTHER PUBLICATIONS

Brochure-SKF-Single Motor Drive System for Spinning Spindles (IMDS).

*Primary Examiner*—Daniel P. Stodola
*Assistant Examiner*—William Stryjewski
*Attorney, Agent, or Firm*—Evenson, McKeown, Edwards & Lenahan

[57] ABSTRACT

A textile spinning or twisting machine which has plurality of units arranged next to one another in a row on one or both sides of the machine which each contain an electric motor. These electric motors are mounted on a supporting body extending in the longitudinal direction of the machine. The supporting body is constructed as a cable duct which, for each electric motor, comprises a motor plate bar and electric lines laid in the longitudinal direction of the machine.

38 Claims, 2 Drawing Sheets

TEXTILE MACHINE, PARTICULARLY A SPINNING OR TWISTING MACHINE

BACKGROUND AND SUMMARY OF THE INVENTION

The invention relates to a textile machine, particularly a spinning or twisting machine, having a plurality of units arranged in a row next to one another on one or both sides of the machine, each of the units comprising an electric motor, these electric motors being mounted on a supporting body extending in the longitudinal direction of the machine.

It is known (Brochure "SKF Spinnspindel" ("SKF Spinning Spindle" of SKF Textilmaschinen-Komponenten GmbH, 7000 Stuttgart 50) to fasten the individual motors, in the case of a ring spinning machine, on a supporting body serving as a spindle rail. Electric supply lines and control lines are housed in a duct arranged at a distance below this supporting body, this duct being divided into two partial ducts by a partition. A wall of the duct is constructed as a detachable lid which exposes one of the partial ducts, specifically the partial duct containing a motor plate bar.

It is also known from German Published Examined Patent Application (DE-A) 37 27 939 to provide, in the case of a textile machine, specifically a spinning machine having an individual motor drive of the spindles, that a motor plate bar is assigned to each of the units. Each of these motor plate bars is connected with a base plate which is equipped with energy supply lines and has a given number of plate bar connections. At least the energy supply lines of two base plates are connected with one another and with a common connection which leads to a central energy supply device of the machine.

It is an object of the invention to improve a textile machine of the initially mentioned type particularly with respect to its construction and also with respect to its mounting possibilities.

This object is achieved according to the invention in that the supporting body is constructed as a cable duct which contains a motor plate bar and electric lines laid in the longitudinal direction of the machine for each electric motor.

By means of this construction, it is achieved that one component may be eliminated, specifically a separate supporting body for the units. This results in a saving of materials which also leads to an improved utilization of space. As a result, the manufacturing expenditures and the mounting expenditures may also be reduced.

In a development of the invention, it is provided that the supporting body is divided into sections following one another in the longitudinal direction of the machine, at which one group of electric motors is mounted respectively and which comprise the pertaining motor plate bars as well as a distributor plate bar connected between this group of motor plate bars and a supply line extending in the longitudinal direction of the machine. As a result, each section is constructed as an autonomous structural unit which can be mounted and demounted separately. In this case, it is advantageous in a further development of the invention for the distributor plate bar to be connected by means of plug-type connections to the lines laid in the longitudinal direction of the machine. As a result, each section is constructed as an autonomous structural unit which can be mounted and demounted separately. In this case, it is advantageous in a further development of the invention for the distributor plate bar to be connected by means of plug-type connections to the lines laid in the longitudinal direction of the machine. As a result, the mounting and demounting is simplified further making it possible to largely exclude sources of errors mainly also during the mounting.

In a further development of the invention, it is provided that the motor plate bars are connected to the respective distributor plate bar by means of lines having plug-type connections. In addition, it is provided in a further development of the invention that the electric motors are connected to the pertaining motor plate bars by means of lines containing plug-type connections. In this manner, it is made possible to separately demount and again mount the respective individual motor plate bars and/or electric motors. Particularly after a demounting, the remaining electric motors may continue to be operated without being disturbed by a demounted motor plate bar and/or a demounted electric motor.

In a further development of the invention, it is provided that supply lines are laid in the supporting body which originate from a machine control system preferably arranged at the machine end, distributor plate bars being connected to these supply lines by means of branchings. As a result, it becomes possible to shut down or expand a whole section while it is not necessary to continue to interrupt the operation of the electric motors of the other sections.

In a further development of the invention, it is provided that the motor plate bars each contain one control unit and switching devices for the assigned electric motor controlled by this control unit. In order to obtain an individual control and in order to permit a clear arrangement of the laid lines, it is also provided that the control unit of a motor plate bar can be controlled by the machine control system by way of signal lines laid in the supporting body and by way of the respective pertaining distributor plate bar. In the case of a textile machine, particularly a spinning or twisting machine, it is also expedient to provide that the control unit of a motor plate bar can be controlled by means of actuating elements of the pertaining unit arranged outside the supporting body. This may, for example, be a yarn detector or a manual switch or the like. In order to ensure a clear arrangement in this case, it is advantageous for the actuating elements to be connected to the respective control unit by way of the distributor plate bar.

In a further development of the invention, it is provided that the control unit of each motor plate bar is connected with switching elements of auxiliary units of each unit. The control unit can therefore also switch the stopping or starting of auxiliary units, such as winding rollers and, if necessary, also the actuating of a cutting device or the like.

In a further development of the invention, it is provided that the control unit is connected with display elements arranged at the respective motor plate bar and/or the pertaining distributor plate bar and/or the machine control system. These display elements which may be assigned to individual operations will then indicate where a disturbance may exist.

In a further development of the invention, it is provided that the supporting body is formed of an essentially C-shaped basic body which can be closed by means of a removable lid to form a duct. This type of a supporting body serving as a cable duct may be opened by the removal of the lid in such a manner that all elements housed in it, particularly the motor plate bars and the distributor plate bar, are easily accessible.

In a further development of the invention, it is provided that the supporting body is divided into two or several partial ducts by means of one or several shields. As a result, it is possible to shield particularly the supply lines in which relatively high currents are flowing with respect to the control units so that no reactions occur which impair the control operation.

In an advantageous embodiment of the invention, it is provided that an essentially U-shaped profile is provided as the shield which is mounted at the wall of the supporting body situated opposite the lid and, with its legs, is directed toward the lid. As a result, it becomes possible to divide the supporting body serving as the cable duct in a simple manner into three partial ducts. In addition, as a result of the removal of the lid, all partial ducts become accessible.

In a further development of the invention, it is provided that the motor plate bars and/or the distributor plate bars are held in the supporting body by means of an easily detachable holding device. As a result, it becomes possible to easily mount and demount the motor plate bars and/or the distributor plate bar.

Other objects, advantages nd novel features of the present invention will become apparent from the following detailed description of the invention when considered in conjunction with the accomanying drawings.

DETAILED DESCRIPTION OF THE DRAWINGS

Figure 1:
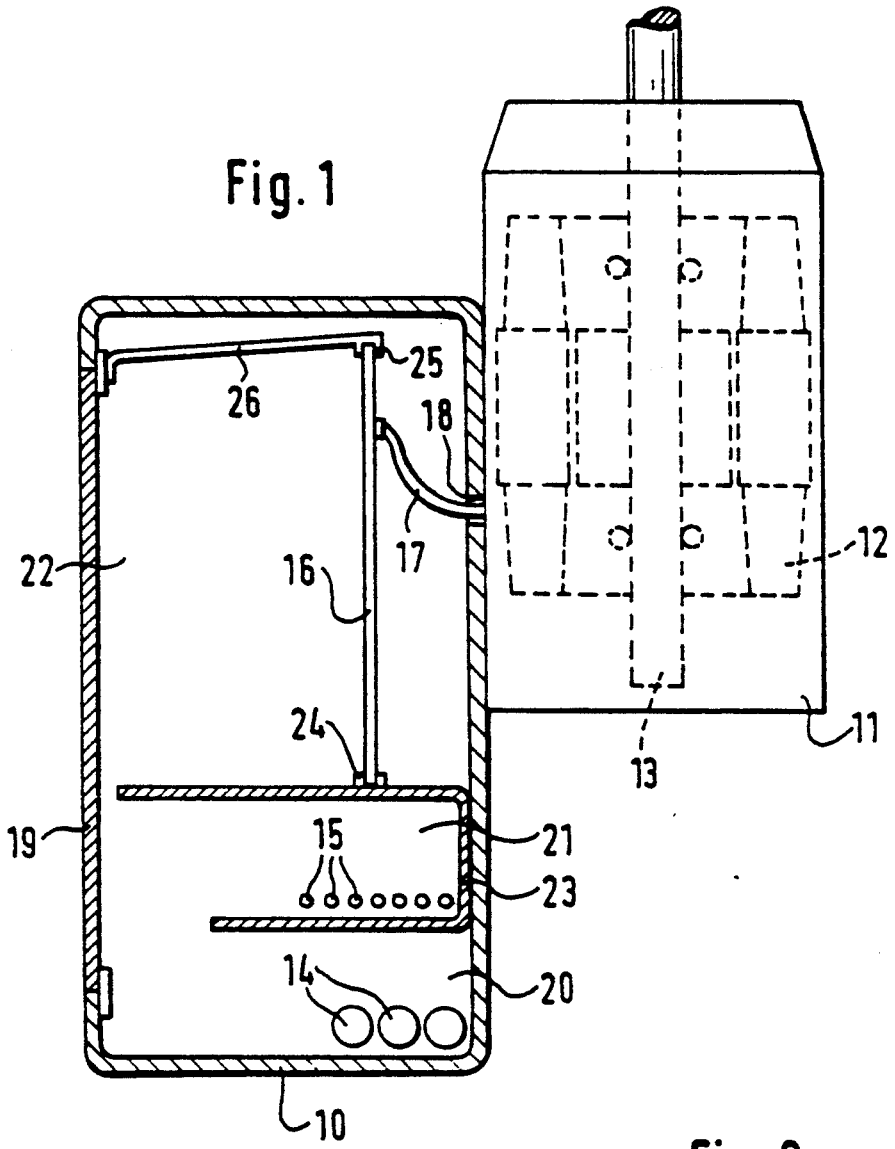
FIG. 1 is a cross-sectional view of a supporting body of a textile machine constructed as a cable duct, having an electric motor arranged at the supporting body and driving, for example, a spindle, constructed in accordance with a preferred embodiment of the invention.

The supporting body 10 shown in FIG. 1 supports a unit 11 of a spinning and twisting machine. The unit comprises its own electric motor 12 which directly drives a spinning or twisting spindle 13. This electric motor 12 is provided with a housing-type component which is fastened directly to a vertical wall of the supporting body 10 formed of a C-shaped profile.

The supporting body is constructed as a cable duct which contains all supply lines 14, signal lines 15 and motor plate bars 16 leading to the plurality of electric motors 12. Connecting lines 17 lead from the motor plate bars 16 to the respective electric motor 12 and are guided through openings 18 of the supporting body 10

On its side opposite the electric motors 12, the supporting body 10 is closed by a lid 19 extending in parallel to the fastening wall, this lid being mounted by means of easily releasable holding elements and being lockable. The supporting body 10 is divided into three partial ducts 20, 21, 22 which are disposed above one another in vertical direction. For this purpose an essentially U-shaped profile 23 extending in the longitudinal direction of the supporting body 10 is mounted at the wall of the supporting body 10 supporting the electric motor 12. The two legs of this profile 23 are disposed horizontally and point from the rear wall of the profile 10 to the lid 19. The upper leg extends almost directly to the lid 19. The lower leg, on the other hand, is shorter so that after the removal of the lid 19 which extends along almost the complete height of the profile of the supporting body 10, the lower partial duct 20 also becomes accessible. The motor plate bars 16 and the pertaining connecting lines as well as a distributor plate bar which will be discussed later are situated in the upper partial duct 22. The motor plate bars 6 have a plate-shaped basic body which, by means of an edge, is inserted into a groove-type longitudinal guide 24 which is arranged on the upper leg of the profile 23. The upper edge of the base plate of the motor plate bar 16 is held by a U-shaped guide 25 of a holding element 26 constructed as a leaf spring. The holding element 26 is fastened in the area of the upper edge of the lid 19 at the profile of the supporting body 10. By a bending of the leaf-spring-type holding element 26 in upward direction, the upper edge of the motor plate bar 16 is exposed so that the motor plate bar 16 may be detached and removed.

The supporting profile 10 constructed as a cable duct is divided in the longitudinal direction of the machine into several sections arranged behind one another. A section of this type, after the releasing of corresponding holding devices at the machine frame, together with the electric motors mounted on it and with the motor plate bars and connecting lines contained in it, may be removed from the machine without the requirement of having to demount the lines extending in the longitudinal direction of the machine, particularly the supply lines 14 and the signal lines 15.

Figure 2:
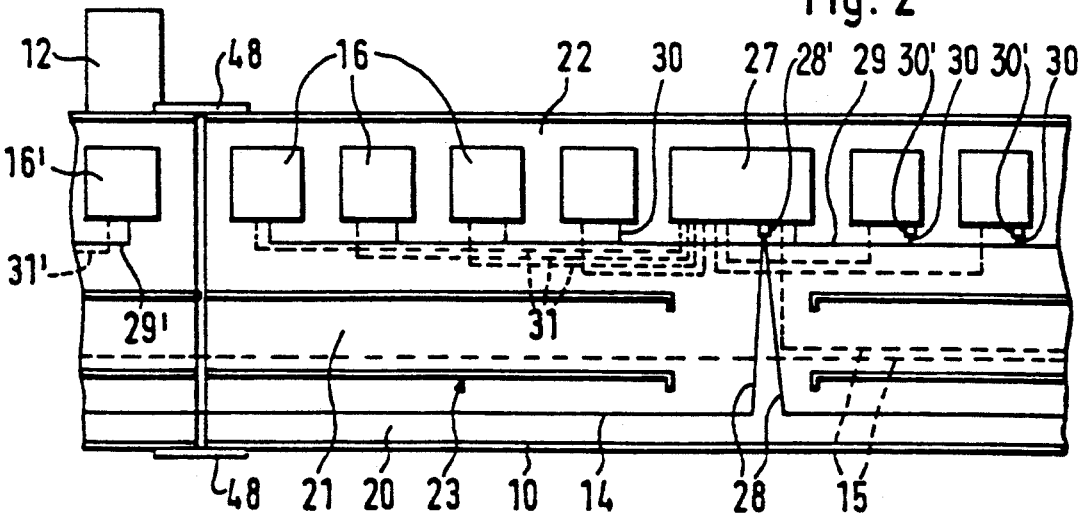
FIG. 2 is a schematic representation of the electric components and lines contained in the supporting body of FIG. 1.

As shown in FIG. 2, motor plate bars 16 corresponding to the number of units 11 or electric motors 12 mounted at the supporting profile 10 are disposed in each section of the supporting profile constructed as a cable duct. In addition, a distributor plate bar 27 is situated in the partial duct 22 which corresponding to the motor plate bars 16 is held in the partial duct 22. The distributor plate bar 27, by way of a branching 28, is connected to the supply lines 14. This branching 28 extends through a gap of the legs of the profile 23 to the motor plate bar 27. The branching 28 connects to distributor plate 27 by way of a plug type connection 28' and which is constructed such that the supply lines 14 are also not interrupted after the pulling off of the plug-type connection.

Supply lines 29 lead from the distributor plate bar 27 to the motor plate bars 16 which are also connected to the motor plate bars 16 by means of plug-type connections 30'. Branchings 30 lead from the supply lines 29 to the individual motor plate bars 16 which are connected with these by means of plug-type connections 30'. Also after the disconnection of one of the plug-type connections 30', the power supply is maintained to the remaining motor plate bars 16. From the distributor plate bar 27, signal lines 31 lead to the individual motor plate bars 16, which lines 31 are shown by an interrupted line in contrast to the supply lines 29. In this case, a respective separate signal line 31 leads from the distributor plate bar 27 to the motor plate bars 16.

Figure 3:
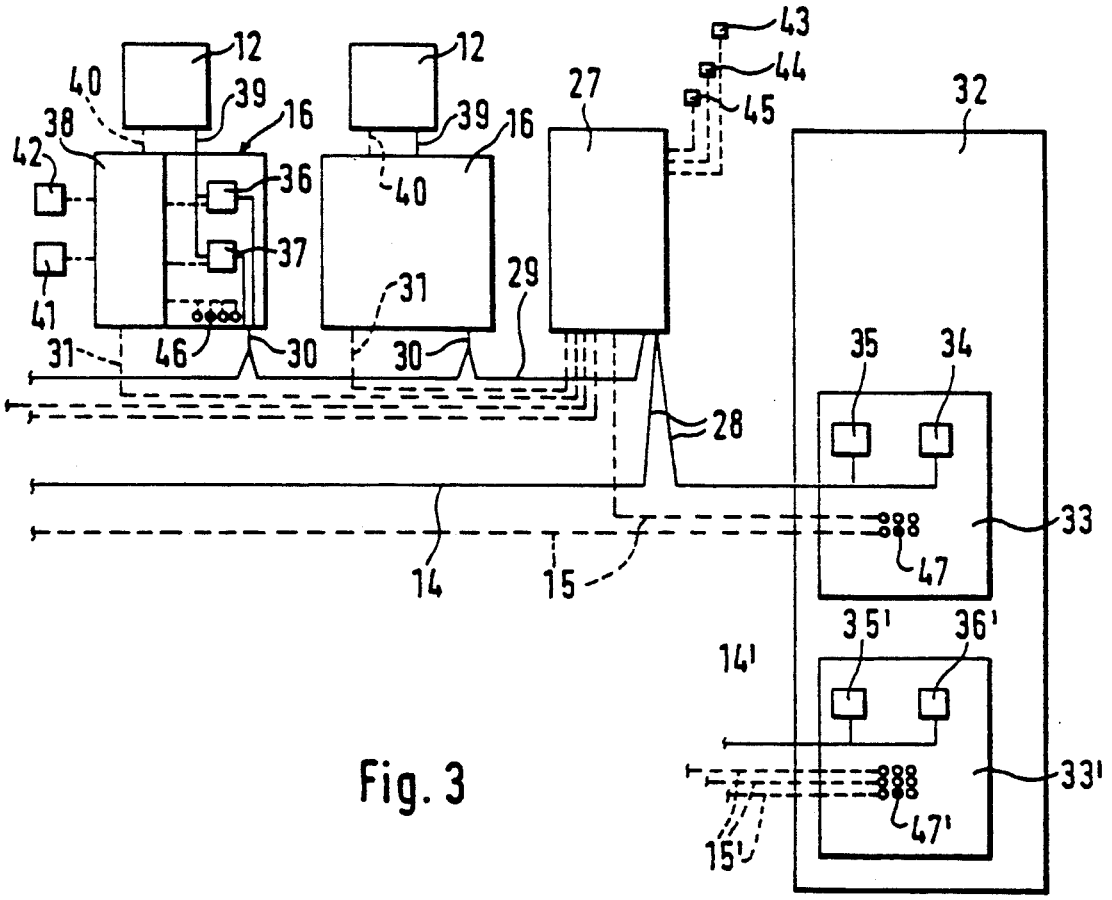
FIG. 3 is a representation of a machine control system arranged at the machine end with further details of the electric elements which are part of a motor plate bar, constructed in accordance with preferred embodiments of the present invention.

The distributor plate bar 27 is connected by way of the signal lines 15 with the machine control system 32 arranged at the machine end (FIG. 3). These signal lines 15 which each lead from the machine control system 32 to the individual distributor plate bars 27, contain leads which correspond at least to the number of motor plate bars. These are preferably constructed as flat cables.

As shown in FIG. 3, the machine control system 32 comprises a control unit 33 which contains a converter 34 and a rectifier 35. The electric motors 12 are supplied by way of the convert 34 with a frequency-controlled alternating current. For the braking of the electric motors 12, the control unit 33, in a manner not shown in detail, is switched to the rectifier 35 so that the electric motors, by means of the same control lines 14 as well as the supply lines 29 of the individual sections, are supplied with direct current. Each motor plate bar 16 comprises relays 36, 37 serving as converters which are controlled by a control unit 38 of the motor plate bar 16. The electric motors 12 are connected to the relays 36, 37 by way of a supply line 39. Furthermore, the electric motors 12 are connected with the control unit 38 by way of a signal line 40 so that a reply exists. For example, by way of the signal line 40, the control unit 38 can be informed of the motor temperature or the bearing temperature so that a braking and stopping takes place in the case of an overheating.

The control unit 38 of each motor plate bar, by way of signal lines, is also equipped with a display device 46 having light-emitting diodes or the like by means of which the operating conditions at the motor plate bar 16 are indicated. The control unit 38 is also connected by way of the signal lines 31, 15 with the display devices 47 of the control unit 33 of the machine control system 32 so that there also a display and/or a utilization of signals can take place.

The control unit 38 of each motor plate bar 16 is connected by way of signal lines with switching elements 41, 42 which are each assigned to the spinning unit which comprises the electric motor 12. This is, for example, a switching device 42 for the stopping of a winding roller of a twisting machine and a switching device 41 for the actuating of a cutting device.

The electric motors 12 can also be stopped individually by means of switches 43, 44, 45 assigned to the respective unit, in which case, if necessary, the switching devices 41, 42 are also actuated. The actuating elements 43, 44, 45 which (deviating from the representation in FIG. 3) are provided at each unit, by way of signal lines, are connected to the distributor plate bar 27 by means of which they are then connected with the corresponding control units 38 by way of the signal lines 31.

As shown in FIG. 3, it is provided in a preferred embodiment that the machine control system 32 is equipped with two control units 33, 33' of which one is, in each case, intended for the units of one machine side.

The supporting body 10 may be constructed as an extruded aluminum profile. However, since it has a simple shape, it is preferably edged from sheet metal. As shown in FIG. 2, sealing elements 48 are provided at joints of the sections of the supporting body 10 so that a sealing off is ensured of the supporting body 10 serving as the cable duct against flying fibers or other dirt.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A textile machine comprising:

a plurality of spinning or twisting units arranged in a row adjacent one another, an electric driving motor for driving each of the units, and a longitudinally extending cable duct having a protective profile for housing a motor plate bar in a fixed position relative to the cable duct for each electric motor and electric supply lines laid in the longitudinal direction of the machine, wherein the electric driving motors are mounted directly on the cable duct with said cable duct serving as a supporting body for the electric motors.

2. A textile machine according to claim 1, wherein the supporting body is divided into separate sections following one another in the longitudinal direction of the machine, a group of electric motors being mounted at each of these sections which comprise the pertaining motor plate bars as well as distributor plate bars which are connected between this group of motor plate bars and a supply line extending in the longitudinal direction of the machine.

3. A textile machine according to claim 2, wherein the distributor plate bar is connected by means of plug-type connections to lines laid in the longitudinal direction of the machine and leading to respective motor plate bars of the group of electric motors in the respective section.

4. A textile machine according to claim 2, wherein the motor plate bars are connected to the respective distributor plate bar by means of lines having plug-type connections.

5. A textile machine according to claim 4, wherein the electric motors are connected to the pertaining motor plate bars by means of lines having plug-type connections.

6. A textile machine according to claim 5, wherein said electric lines include supply lines laid in the supporting body which original from a machine control system arranged at the machine end, these supply lines being connected to the distributor plate bars by means of branchings.

7. A textile machine according to claim 6, wherein the electric lines include signal lines provided inside the supporting body between each motor plate bar and the pertaining distributor plate bar and signal lines laid inside the supporting body between the distributor plate bars and the machine control system.

8. A textile machine according to claim 7, wherein a supply line originating from the pertaining distributor plate bar is laid inside a section of a supporting body, this supply line being connected to the pertaining motor plate bars by way of branchings.

9. A textile machine according to claim 8, wherein the motor plate bars each comprise a control unit and switching devices for the assigned electric motor controlled by this control unit.

10. A textile machine according to claim 9, wherein the control unit of a motor plate bar can be controlled by a machine control system by way of signal lines laid in the supporting body and by way of the respective pertaining distributor plate bar.

11. A textile machine according to claim 10, wherein the control unit of a motor plate bar can be controlled by means of actuating elements of the pertaining unit arranged outside the supporting body.

12. A textile machine according to claim 11, wherein the actuating elements are connected to the respective control unit by way of the distributor plate bar.

13. A textile machine according to claim 2, wherein said electric lines include supply lines laid in the supporting body which originate from a machine control system arranged at the machine end, these supply lines being connected to the distributor plate bars by means of branchings.

14. A textile machine according to claim 13, wherein the electric lines include signal lines provided inside the supporting body between each motor plate bar and the pertaining distributor plate bar, and signal lines inside the supporting body between the distributor plate bars and the machine control system.

15. A textile machine according to claim 2, wherein signal lines originating from the pertaining distributor plate bar are laid inside a respective section of the supporting body and are connected to the pertaining motor plate bars by way of branchings.

16. A textile machine according to claim 2, wherein the motor plate bars each comprise a control unit and switching devices for the assigned electric motor controlled by this control unit.

17. A textile machine according to claim 16, wherein the control unit of a motor plate bar can be controlled by a machine control system by way of signal lines laid in the supporting body and by way of the respective pertaining distributor plate bar.

18. A textile machine according to claim 17, wherein the control unit of a motor plate bar can be controlled by means of actuating elements of the pertaining unit arranged outside the supporting body.

19. A textile machine according to claim 18, wherein the actuating elements are connected to the respective control unit by way of the distributor plate bar.

20. A textile machine according to claim 16, wherein the control unit of each motor plate bar is connected with switching elements of auxiliary units of the respective unit.

21. A textile machine according to claim 16, wherein the control unit is connected with display elements arranged at one of the respective motor plate bars, the pertaining distributor plate bar, and a machine control system.

22. A textile machine according to claim 16, wherein the electric motors are connected to a respective motor plate bar by way of a supply line and at least one signal line leading to the respective associated control unit.

23. A textile machine according to claim 2, wherein the supporting body is divided into a plurality of partial ducts by means of at least one shield.

24. A textile machine according to claim 23, wherein the motor plate bars and the distributor plate bars and the lines connecting a respective distributor plate bar to respective motor plate bars are arranged in a first of said partial ducts.

25. A textile machine according to claim 24, wherein a signal lines, which are arranged between the distributor plate bars 27 and the machine control system, are laid in a second of said partial ducts which is shielded from the first partial duct.

26. A textile machine according to claim 25, wherein the supply lines extending through in the longitudinal direction of the machine and originating from a machine control system are laid in a third of said partial ducts which is shielded from the first parallel duct and from the second partial duct.

27. A textile machine according to claim 26, wherein the second partial duct is arranged between the first and the third partial duct.

28. A textile machine according to claim 27, wherein the lid forms a common wall for all partial ducts.

29. A textile machine according to claim 28, wherein an essentially U-shaped profile is provided as a shield and is mounted at the wall of the supporting body which is opposite the lid, and is directed toward the lid with its legs.

30. A textile machine according to claim 23, wherein the supporting body is formed of an essentially C-shaped basic body which can be closed to form a duct by means of a removable lid.

31. A textile machine according to claim 30, wherein the lid forms a common wall for all partial ducts.

32. A textile machine according to claim 2, wherein the motor plate bars are held in the supporting body by means of a releasable holding device.

33. A textile machine according to claim 32, wherein the motor plate bars each have a base plate which is inserted by means of an edge into a guide groove extending preferably in the longitudinal direction of the machine and which is held at the opposite edge by means of a base plate by the holding device which comprises a spring-elastically flexible element pressing the motor plate bar into the guide groove.

34. A textile machine according to claim 2, wherein the distributor plate bars are held in the supporting body by means of a releasable holding device.

35. A textile machine according to claim 34, wherein the motor plate bars each have a base plate which is inserted by means of an edge into a guide groove extending preferably in the longitudinal direction of the machine and which is held at the opposite edge by means of a base plate by the holding device which comprises a spring-elastically flexible element pressing the motor plate bar into the guide groove.

36. A textile machine according to claim 2, wherein the supporting body is formed of an essentially C-shaped basic body which can be closed to form a duct by means of a removable lid.

37. A textile machine according to claim 1, wherein the electric motors are connected to the pertaining motor plate bars by means of lines having plug-type connections.

38. A textile machine according to claim 1, wherein the supporting body is formed of an essentially C-shaped basic body which can be closed to form a duct by means of a removable lid.

* * * * *